US006374511B1

(12) United States Patent
Iwata

(10) Patent No.: US 6,374,511 B1
(45) Date of Patent: Apr. 23, 2002

(54) ACTIVATION METHOD OF TEXTILE PRODUCTS AND APPARATUS THEREOF

(76) Inventor: Takuzo Iwata, 12-27, kusubanamiki 1-chome, Hirakata-shi, Osaka 573-1118 (JP)

( * ) Notice: Subject to any disclaimer, the term of this patent is extended or adjusted under 35 U.S.C. 154(b) by 93 days.

(21) Appl. No.: 09/781,758

(22) Filed: Feb. 12, 2001

(30) Foreign Application Priority Data

Oct. 4, 2000 (JP) ..... 2000-305341

(51) Int. Cl.[7] ..... F26B 3/34

(52) U.S. Cl. ..... 34/248; 8/444; 34/218; 34/232

(58) Field of Search ..... 34/61, 69, 218, 34/248, 250, 265, 274, 281, 390, 245; 252/8.61; 8/444

(56) References Cited

U.S. PATENT DOCUMENTS 4,187,615 A * 2/1980 Iwata ..... 34/250
4,631,836 A 12/1986 Iwata
5,344,462 A * 9/1994 Paskolov et al. ..... 8/115.52
5,403,453 A * 4/1995 Roth et al. ..... 204/164

FOREIGN PATENT DOCUMENTS

JP 61-231257 10/1986

* cited by examiner

*Primary Examiner*—Teresa Walberg
*Assistant Examiner*—Thor Campbell
(74) *Attorney, Agent, or Firm*—Merchant & Gould P.C.

(57) ABSTRACT

A corona discharge apparatus 2 is provided as an ionized gas irradiation means above a plate 3 on which a textile product 2 is placed. The ionized gas E generated by the corona discharge apparatus 4 is irradiated to the textile product 2 and the textile product is activated. The ionized gas E penetrates into the textile product 2 from surface to back under the influence of the magnetic field generated by the plate 3. The textile product 2 is fully ionized from surface to back by this method and apparatus.

6 Claims, 9 Drawing Sheets

FIG.4–A
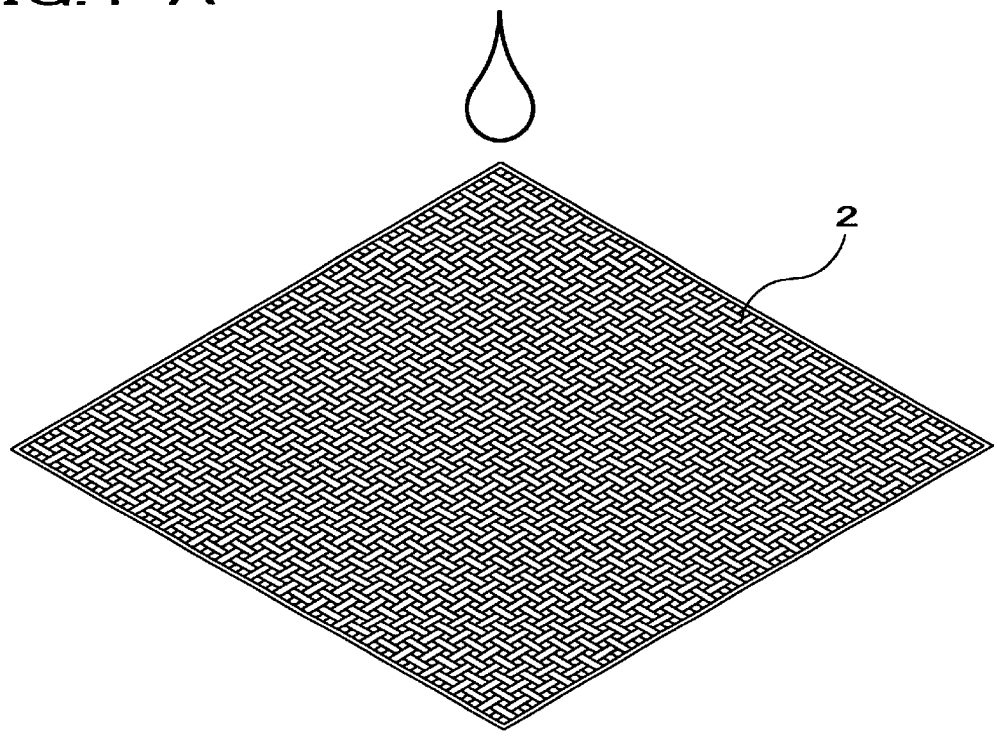
FIG.4–B
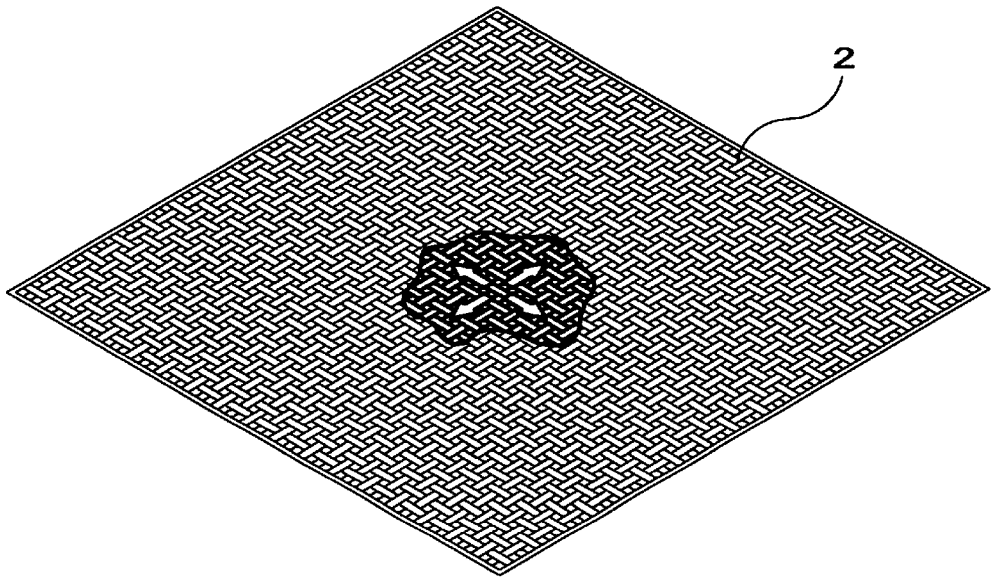

FIG.5–A
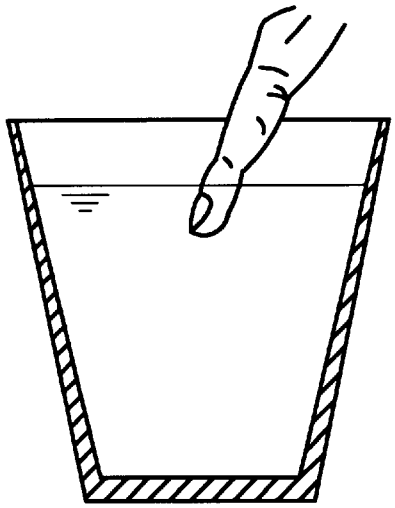
FIG.5–B
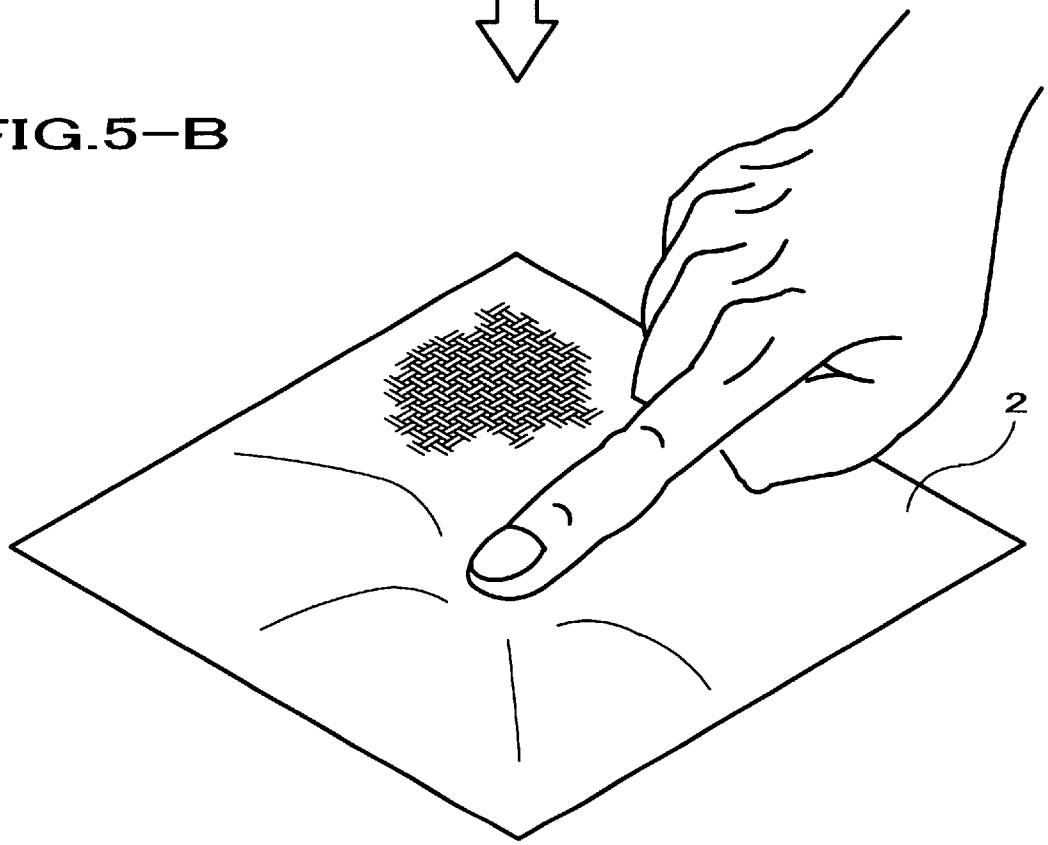

FIG.6–A
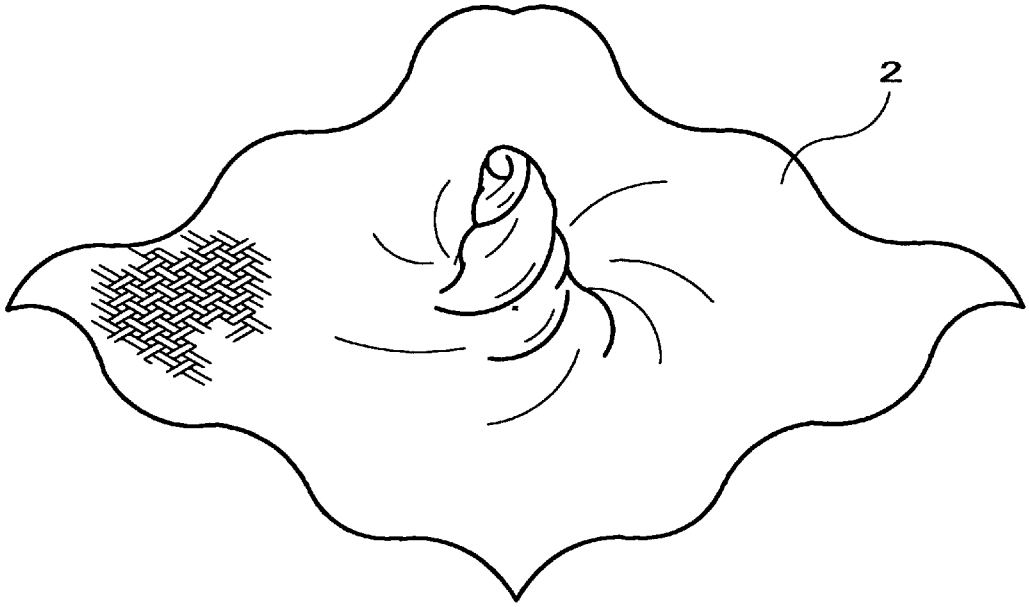
FIG.6–B
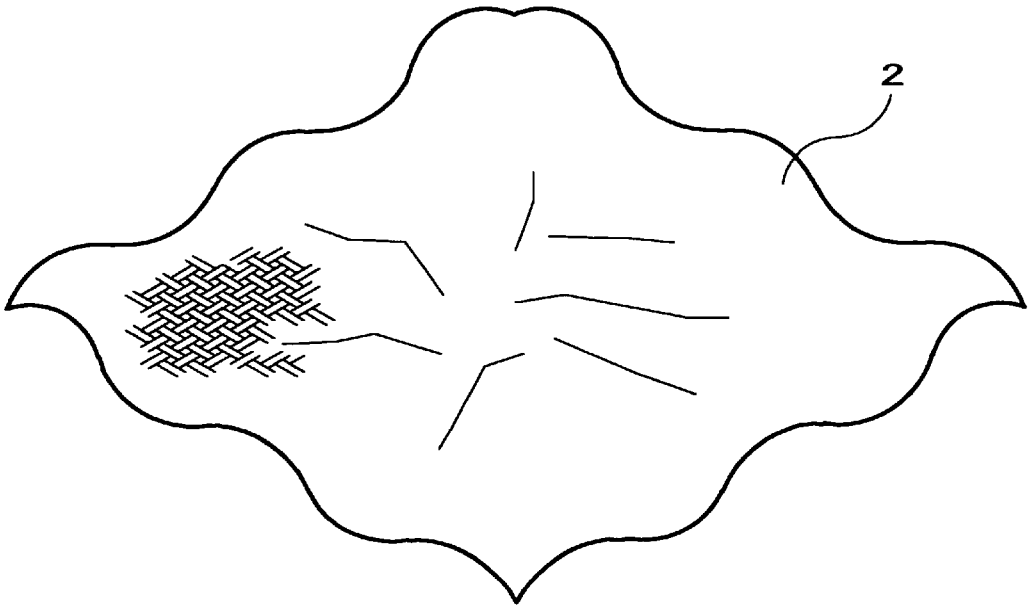

FIG.8–A
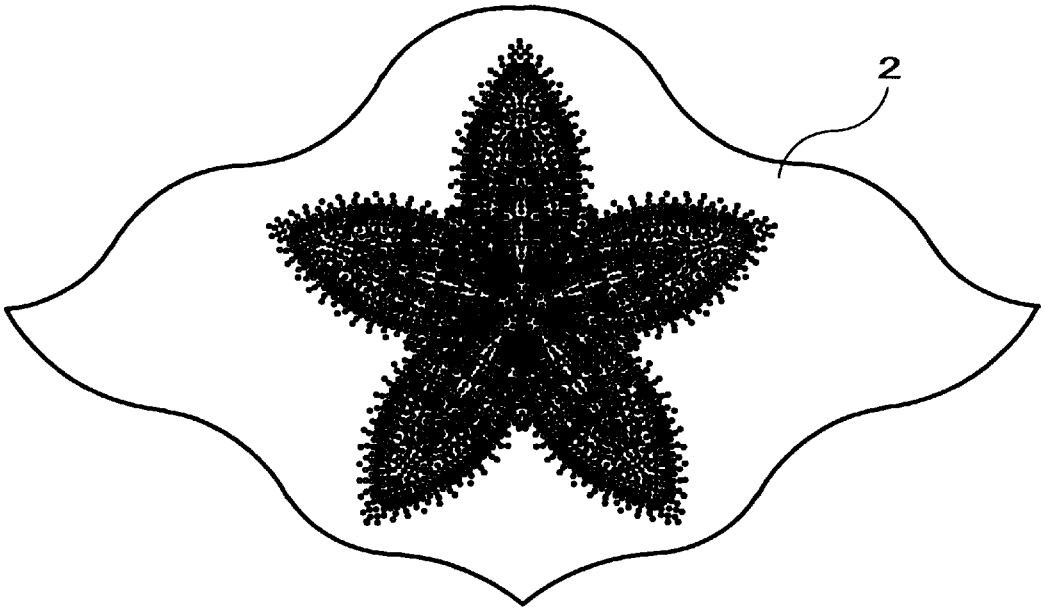
FIG.8–B
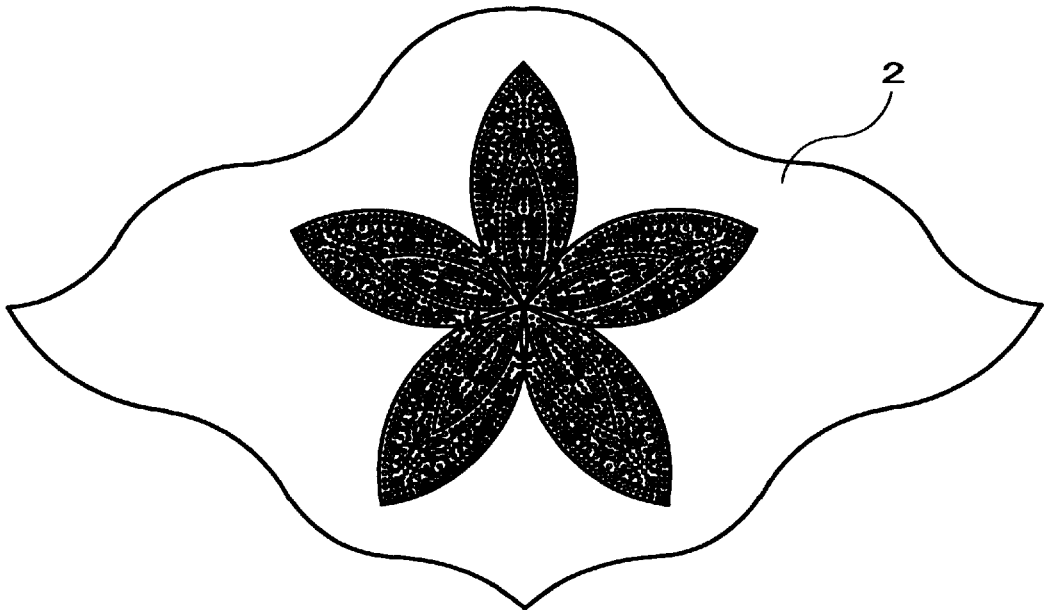

FIG.9

| Item | Present invention<br>Ionized air applied in magnetic field | Prior art<br>Ionized air applied |
|---|---|---|
| Time ratio | 1/5 | 1 |
| Breakthrough distance | Longer | 1<br>(surface) |
| Water absorbency | Larger | 1 |
| Crease<br>(wool) | Reduced | 1 |
| Twist and natural recovery | No | Yes |
| Dyestuff brightness | Brilliant | 1 |
| Degree of swelling | Larger | 1 |
| Weaving pattern | Warp,weft, orientated | Partly distorted |
| Fluff | None | Partly Yes |
| Tensile strength | Larger | 1 |

ACTIVATION METHOD OF TEXTILE PRODUCTS AND APPARATUS THEREOF

BACKGROUND OF THE INTENTION

1. Field of the Invention

The present invention relates to an activation method of textile products and an apparatus thereof. Particularly, the present invention relates to the activation method by applying magnetic field to accelerate activation of textile products and the apparatus thereof.

2. Prior Art

As known activation methods of the textile products, there have been the following methods:

(1) A plurality of ionized air nozzles and a plurality of natural air nozzles are provided alternately with a predetermined distance each other in a passage through which a textile product or textile products to be processed are placed. The textile product or the textile products go through the passage where an ionized air and natural air are filled alternately. Said textile product or textile products are exposed to the ionized air repeatedly and surface of said textile product or textile products is activated, and (2) The textile product or the textile products to be ionized are placed in a processing chamber. The ionized air generated by an ion generator and fresh natural air are alternately filled in the processing chamber and the textile product or the textile products are ionized repeatedly. (Refer to Japanese unexamined patent publication 61-231257.)

Like that, in the known activation methods of textile products, the ionized air atmosphere and natural air atmosphere are alternately fed and the textile products are activated under such atmosphere. However, it has been pointed out that the ionized air cannot sufficiently breakthrough the textile products to be processed. For this reason, when thicker textile products are activated, said thicker textile products are required to be irradiated with the ionized air by repeatedly as turning inside out.

When said textile products are activated with the ionized air generated by means of corona discharge apparatus, said textile products are easily deteriorated by ozone generated together with the ionized air.

The present invention has been made with the foregoing background in mind. The object of the present invention is to activate the whole parts of the textile products effectively at a time by increasing the degree of penetration of the ionized air into said textile products.

SUMMARY OF THE INVENTION

The present invention offers an activation method of a textile product or textile products (hereinafter referred to as only textile product) by irradiating an ionized gas to the textile product, said textile product being placed in magnetic field when it is processed. Materially, the present invention offers a method to generate a magnetic field and provides an irradiation means to supply an ionized gas to the textile product placed in the magnetic field.

The textile product is irradiated with an ionized gas according to the method and apparatus of the present invention. For instance, the textile product is irradiated with one of the gases introduced from a group including argon, helium, nitrogen gas, air, etc. generated by means of a corona discharge apparatus. The magnetic field can increase the degree of penetration of the ionized gas through the textile product. The magnetic field also can increase amounts of the irradiated ionized gas per unit area of the textile product to be processed. The textile product is activated both surface and reverse sides. Moreover, whole parts inside of said textile product are also fully activated.

In case if an ionized air is applied in place of an ionized gas, the cost will be much decreased.

Further, if natural air is added to an ionized air, ozone existing in the ionized air is diluted. The textile product will be prevented from being deteriorated due to existence of ozone.

When an ionized gas generated by corona discharge apparatus is irradiated to the textile product placed in the magnetic field, the magnetic field increases the degree of penetration of the ionized gas breaking through the textile product and concurrently the magnetic field increases amounts of the ionized gas to breakthrough the textile product per unit area. Thus, said textile product is activated both surface and reverse sides. Further, whole parts inside said textile product are also fully activated.

BRIEF EXPLANATION OF THE DRAWINGS

FIG. 4 illustrates an evaluation method of water absorbency of the textile product.

FIG. 5 illustrates another evaluation method of water absorbency of the textile product.

FIG. 6 illustrates an evaluation method of recoverability of the textile product.

FIG. 8A, 8B illustrate variations of color, luster and contrast thereof in the textile product.

FIG. 9 illustrates a variation of physical property of the textile product.

DETAILED EXPLANATION OF THE PREFERRED EMBODIMENTS OF THE INVENTION

Now an example of activation method and apparatus thereof according to the present invention is explained with reference to the accompanied drawings.

Figure 1:
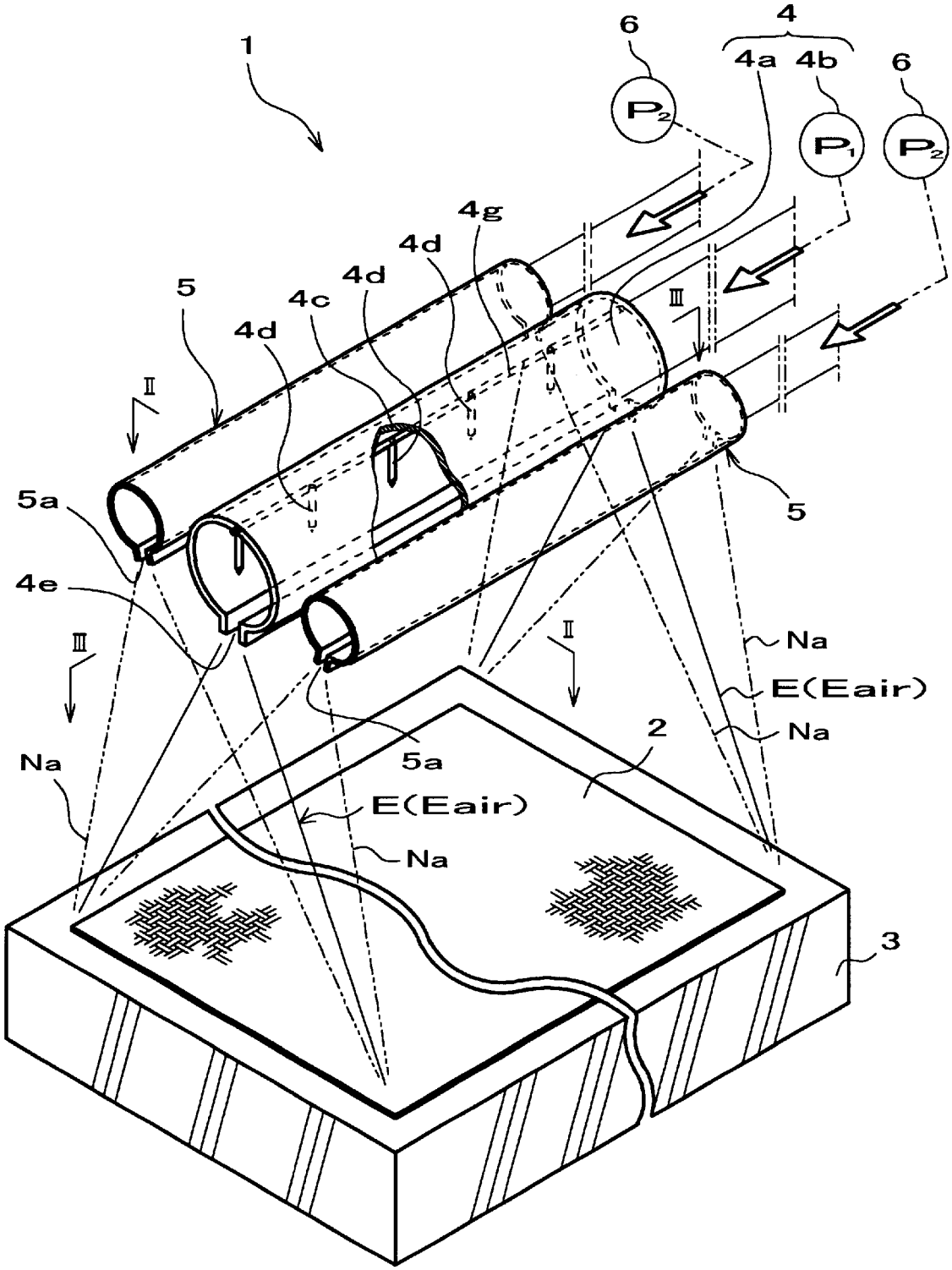
FIG. 1 is a perspective view illustrating an activation apparatus for the textile product according to the present invention.
Figure 2:
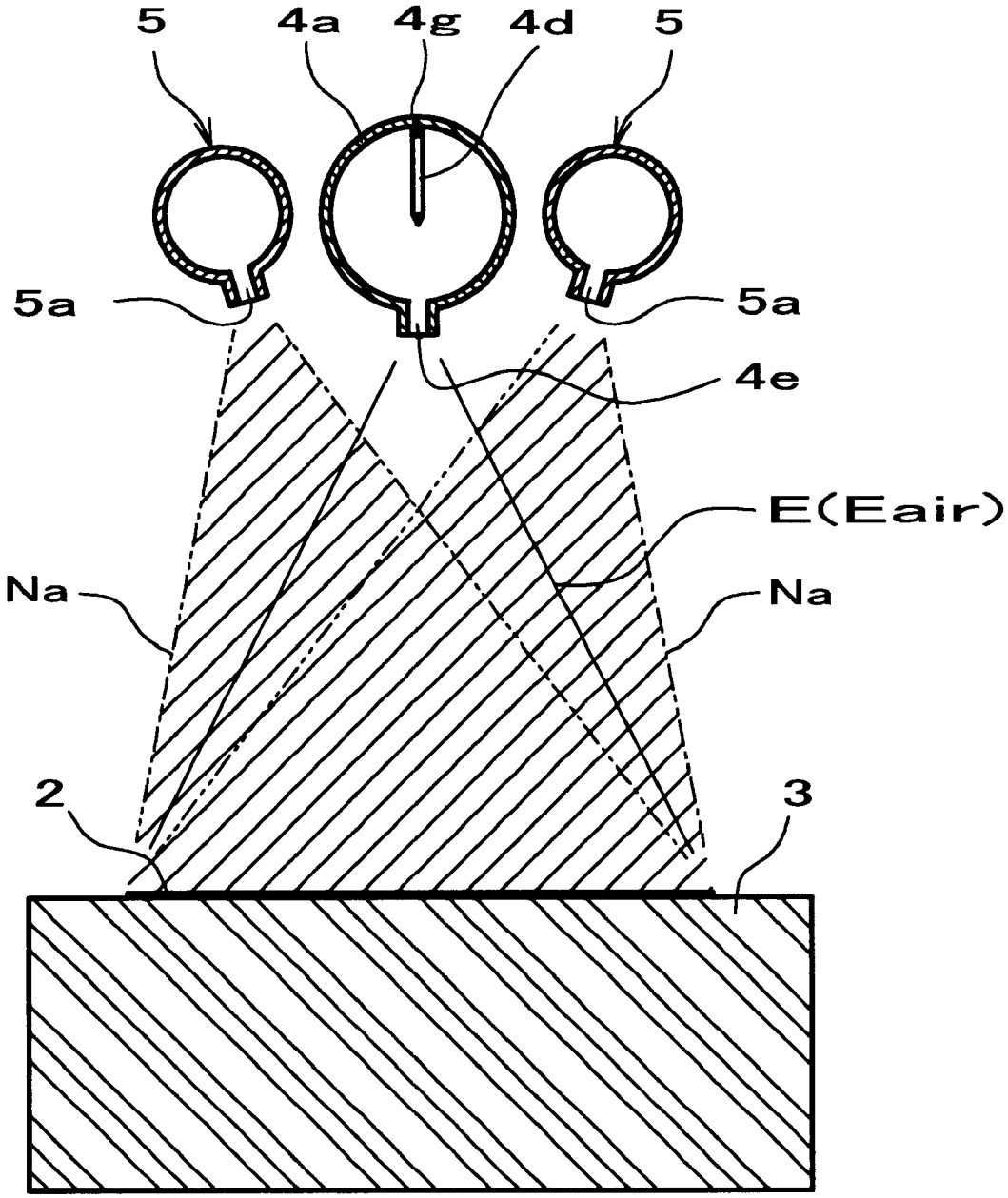
FIG. 2 is a cross-sectional view of the activation apparatus for the textile product taken along II—II line in FIG. 1 according to the present invention.
Figure 3:
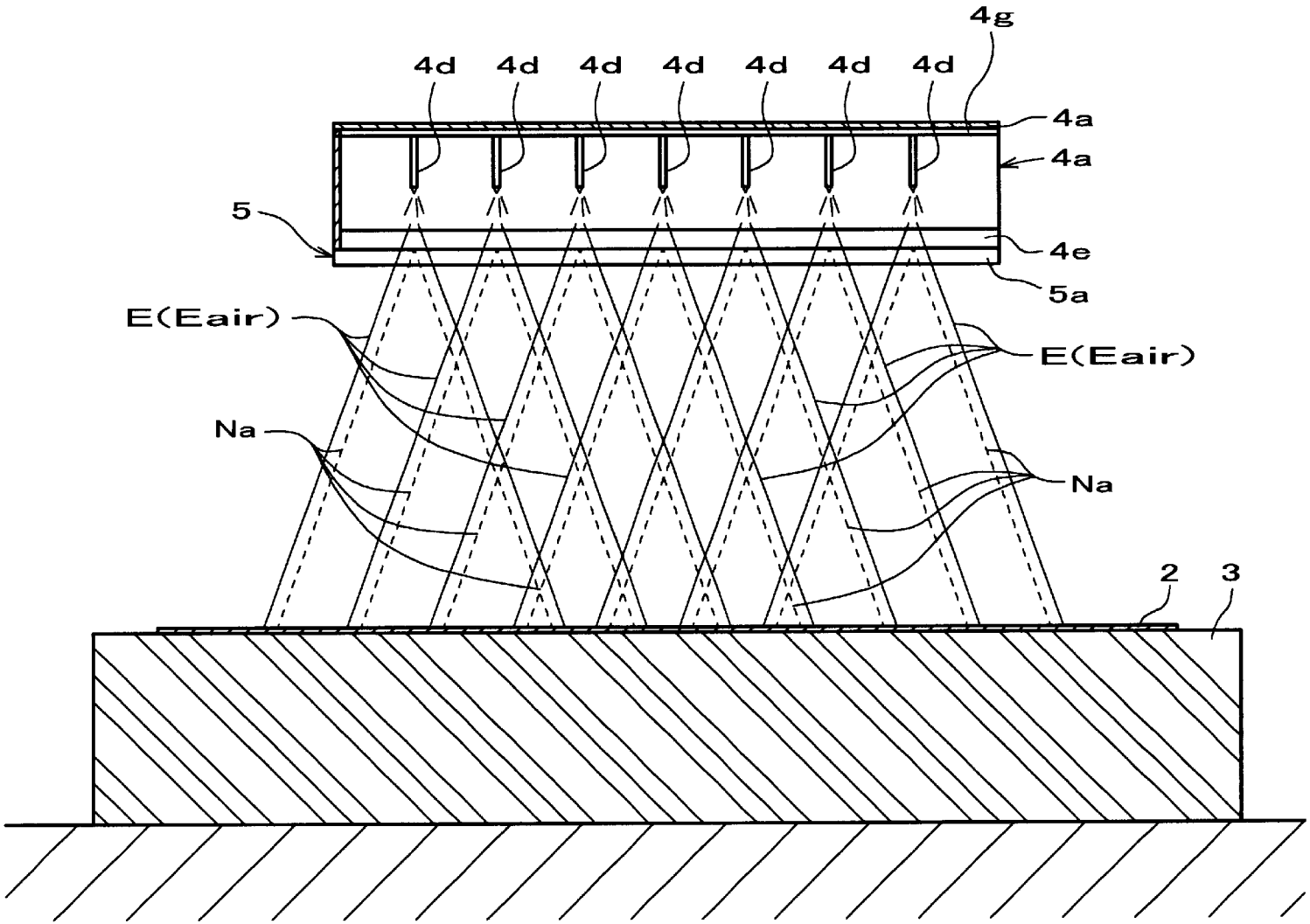
FIG. 3 is a longitudinal side view of the activation apparatus for the textile product taken along III—III line in FIG. 1 according to the present invention.

FIG. 1 is a perspective view indicating an activation apparatus 1 of the textile product according to the present invention. FIG. 2 is a cross-sectional view indicating an activation apparatus taken along the II—II line of FIG. 1 according to the present invention. FIG. 3 is a longitudinal side view indicating the activation apparatus taken along the III—III line of FIG. 1 according to the present invention.

As indicated in FIG. 1 to FIG. 3, a corona discharge apparatus is provided as a means of generating an ionized gas. The corona discharge apparatus 4 is placed above a plate 3 on which the textile product 2 to be treated according to the present invention is placed. The corona discharge apparatus 4 irradiates an ionized gas E. The ionized gas E activates the textile product 2.

The corona discharge apparatus 4 comprises a corona discharge part 4*a* and a compressor 4*b* (indicated as reference letter P1 in FIG. 1). The compressor 4*b* supplies one of the ionized gases introduced from a group including argon, helium, nitrogen, natural air, etc. to the corona discharge part 4*a*.

The corona discharge part 4*a* comprises a cylindrical element 4*c* with a predetermined length and a plurality of electrodes 4*d*, 4*d*, . . . provided on the internal surface of the cylindrical element 4*c*. Said plurality of electrodes 4*d*, 4*d*, . . . are electrically communicated with a common electrode 4*g*. There is provided a slit aperture 4*e* at opposite side of attachment of electrodes 4*d*, 4*d*, . . . to the common electrode 4*g*. The slit aperture 4*e* irradiates the ionized gas E.

The length of said cylindrical element 4*c* in longitudinal direction corresponds to the maximum width of said plate 3 and said slit aperture 4*e* is formed through said cylindrical element 4*c* from one end to the other.

The voltage supplied between said electrodes 4*d*, 4*d*, . . . and inner surface of said cylindrical element 4*c* is preferably to be a degree of voltage just before generating arc, e. g., 10,000 V. When an inactive gas, such as argon, helium, nitrogen gas, is supplied to said cylindrical element 4*c*, a gas storage tank or cylinder may also be directly communicated to said cylindrical element 4*c*.

When the corona discharge apparatus 4 is actuated to generate corona discharge between said cylindrical element 4*c* and electrodes 4*d*, 4*d*, . . . , the gas (argon, helium, nitrogen gas, air, etc.) supplied to said cylindrical element 4*c* is polarized and ionized, and the ionized gas E is irradiated to the plate 3 through the slit aperture 4*e* by means of discharge energy of corona discharge apparatus 4.

As aforementioned, said plate 3 is preferably composed of magnet. At least whole surface of the upper part of said plate 3 on which the textile product 2 is placed is made of magnet (permanent magnet or electromagnet).

The magnetic flux induces the ionized gas E toward the plate 3 to shut said ionized gas E into the magnetic field. Concurrently, the magnetic field increases penetration ability of said ionized gas through the textile product 2.

When natural air is ionized (hereinafter referred to as Eair) and applied to activate the textile product 2, ozone generated by corona discharge is diluted with natural air (hereinafter referred to as Na) supplied from an air supply apparatus 5.

An air injector 5*a* of the air supply apparatus 5 is provided obliquely downward to make the natural air Na join to the ionized natural air Eair prior to its reaching the textile product 2. In the preferred embodiments of the present invention it is clearly observed that ozone is fairly decreased. Said air supply apparatus 5, 5 are provided outside said cylindrical element 4*c*, respectively, and a compressor 6 (indicated as reference letter P2 in FIG. 1) is communicated to each air supply apparatus 5, 5, respectively, to supply natural air.Na.

Next, the activation method of textile product according to the present invention is explained.

As indicated in FIG. 1 to FIG. 3, said corona discharge apparatus 4 is provided above the plate 3 and the aperture 4*e* of said corona discharge part 4*a* is provided obliquely downward the plate 3. It is recommended to determine the distance between the surface of the plate 3 and the aperture 4*e* approximately 35 cm.

When Eair is irradiated to the textile product 2 to activate said textile product, the air supply apparatus 5, 5 are provided at both sides of the cylindrical element 4*c* of the corona discharge apparatus 4 facing to the upper surface of the plate 3.

The corona discharge apparatus 4 is controlled by a control panel (not shown). The discharge volt is set to the voltage just before generating an arc at each electrode 4*d*.

The corona discharge apparatus 4 is actuated as supplying gas to be ionized to the cylindrical element 4*c* of said corona discharge apparatus 4. An inactive gas such as air, argon, helium, etc. supplied to the cylindrical element 4*c* is ionized by means of corona discharge at an electrode 4*d*, 4*d*, . . . and irradiated to the textile product 2 through the aperture 4*e* by means of discharge energy.

When an ionized air Eair is irradiated to the textile product 2, the aperture of the air injector 5*a* of the air supply apparatus 5 is provided obliquely downward so that the air may cross the course of the ionized air Eair. Natural air supplied from the aperture of the air injector 5*a* dilutes the ozone existing in the Eair and decreases amount of the ozone per unit area before it reaches the textile product 2.

The ionized gas E reaches back of the textile product 2 passing through said textile product by being inducted to the magnetic field formed by the plate 3 comprising the magnet. As a result, the textile product 2 is fully activated through the whole parts, as well as its surface and back.

FIG. 9 indicates variation of physical property of the textile product 2 when Eair is irradiated to said textile product from outside the magnetic field by means of said activation apparatus 1. The variation of the physical property of the textile product 2 prepared by known technique is comparatively indicated. In FIG. 9 the variation of the physical property of said textile product prepared by known technique is set 1 as standard and the physical property of said textile product according to the present invention is comparatively indicated.

In the embodiments of the present invention, said plate 3 is a plate comprising a permanent magnet of approximately 13,000 gauss. The discharge volt from the corona discharge apparatus is 10,000 V. The distance between the aperture part 4*e* of the cylindrical element 4*c* and the surface of the plate 3 is 35 cm.

As textile product 2, cotton handkerchief, cotton towel, camel's hair, plain silk goods and baby's cotton blanket are tested. The items of physical property of the textile product 2 are selected, taking into consideration practical importance such as, water absorbency, feeling by hand, recovering degree after squeezing, creases, fluff, color, clearance of color, etc. Furthermore, orientations of fiber, degree of deterioration of fiber itself, variation of tensile strength, are selected too.

When water absorbency is evaluated, cotton handkerchief and towel are applied. First method is to evaluate a speed during which water is fully absorbed into the handkerchief and the towel, said water being dropped from the same level above the handkerchief and the towel (FIG. 4). Second method is to evaluate degree of dryness of wet finger dipped into a water vessel and pressed onto said handkerchief and towel (FIG. 5).

The first and the second methods disclosed by FIG. 4 and FIG. 5 for testing water absorbency of the textile product prepared according to the present invention indicated excellent results when compared with the water absorbency obtained in examples treated with the ionized air by known technique.

When observed with a magnifying glass, the degree of swelling of each yarn composing a single twisted yarn of the textile product 2 prepared according to the present invention is different, namely, the clearance between each yarn is closer than that of each yarn composing a twisted yarn of the testing material prepared by known technique. The degree of swelling of the handkerchief and the towel prepared according to the present invention is larger than the one prepared by known technique.

Accordingly, better water absorbency of the present invention is assumed caused by variation of the degree of swelling achieved according to the present invention. Furthermore, it is observed that the degree of swelling obtained according to the present invention is endurable against the force given from outside. It was firmly observed that an excellent endurance degree of swelling of the yarn prepared according to the present invention is kept against the external pressure of long hours. Accordingly, said water absorbency and softness of the textile product prepared according to the present invention remained for long hours.

Next, a thicker baby blanket comprising cotton yarns is prepared according to the present invention for evaluating the degree of penetration of the ionized air.

The ionized cotton blanket prepared with known technique is swelled only surface on which ionized air Eair was irradiated and it became soft. However, its back face was not swelled but remained hard.

On the other hand, when a cotton blanket prepared according to the present invention is irradiated with the ionized air Eair from outside the magnetic field, said cotton blanket was swelled from surface to back and whole parts were swelled. The blanket was entirely swelled. Finger felt soft feeling over the whole parts of the blanket; as it were feeling and appearance of ram wool were obtained.

Accordingly, the ionization method and ionization apparatus for the textile product by irradiating the Eair from outside the magnetic field to the textile product 2 placed in the magnetic field offers far excellent results when compared with the blanket prepared by known technique.

Next, recovery of the cotton blanket prepared by irradiation of ionized air Eair from outside the magnetic field to the textile product placed in the magnetic field, and the cotton blanket prepared by irradiation of ionized air Eair prepared by known technique is compared.

For instance, as indicated in FIG. 6(*a*), picking a part of the cotton blanket with fingers and twisted it several times and then unpicked it. Existence of crease remained on the cotton blanket and degree of such crease was observed.

The cotton blanket ionized according to the present invention is not admitted existence of crease. On the other hand, the cotton blanket prepared by known technique was observed a plurality of creases.

As aforementioned, assuming that the cotton blanket prepared according to the present invention is swelled from surface to back, it is presumed that swelling imparts a good result of recovery after wringing the cotton blanket.

Next, variation of contrast of color and pattern are observed with colored and patterned silk good and cotton handkerchief was observed.

FIG. 8B indicates contrast of color and pattern of the silk goods irradiated with ionized air Eair according to the present invention. On the other hand, FIG. 8A indicates contrast and pattern of the silk goods prepared by known technique.

Clarity and luster of the surface of the goods prepared according to the present invention was far improved comparing with the products prepared by known technique.

In particular, in the case that the patterned cotton handkerchief is irradiated with the ionized air Eair, the luster of said patterned cotton handkerchief is appeared as if it were just prepared silk product. Hand feeling and skin feeling are almost the same as the silk product just prepared.

The ionized air Eair is attracted by the magnetic field and forcedly retained inside the textile product. Large amounts of the ionized air Eair are forced to breakthrough the textile product. Accordingly, the detail inside the textile product that has not been observed so far could be observed. Accordingly, it is presumed that even inside the textile products, as well as surface, were improved.

Almost no fluff is observed through a magnifying glass on the surface of the textile product 2 prepared according to the present invention.

When an original camel's hair is observed, the hair irradiated with the ionized air Eair prepared according to the present invention indicated as it were golden luster after irradiation, though it was a dark brown before irradiation.

It was observed through a magnifying glass that outside surface of each fiber is increased its clearance degree and a thinner axis is observed along the center of the fiber.

Figure 7:
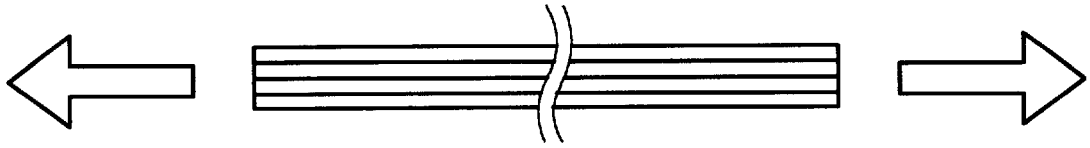
FIG. 7 illustrates an evaluation method of strength of the textile product.

FIG.7 indicates a fiber or thread irradiated with the ionized air Eair according to the present invention and by known technique, respectively, for comparing purposes. It was possible to break a fiber or yarn prepared by known technique with weak strength. On the contrary, the fiber or thread prepared according to the present invention could not be broken even with larger strength.

As aforementioned, assuming that color, luster and transparency of the light are all increased by irradiation of the ionized air Eair to the textile product. It is further presumed that inside orientation of the fiber is also improved by irradiation of the ionized air Eair.

If the same improvements of the physical property obtained in the textile product prepared according to the present invention is expected for the textile product prepared by known technique, said textile product prepared by known technique must be irradiated with the ionized air Eair as much as five times its surface and back, without saying kinds of the textile products.

Accordingly, as indicated in FIG. 9, if the textile product prepared by known technique is expected to have the same improvement of quality as that of the textile product prepared according to the present invention, it will take hours almost as much as five times. However, it is still not possible to expect an improvement of fiber quality inside a yarn.

In the embodiments of the present invention, the plate 3 is designated as the means to generate the magnetic field, but it is of course recommended to provide a magnet to accelerate irradiation of the ionized gas E(Eair). In this case it becomes possible to expect the same improvement as discharge energy.

For instance, in this connection, if wool muffler is irradiated with ionized air Eair for activation, appearance and feeling of the wool muffler is almost identical with Angola. If the ionized air Eair is irradiated to a necktie the texture of weaving of the necktie does not become easily detracted. In other words, recovering ability against tightening crease in necktie is far improved.

In the applied way of the present invention, it is recommended to place a magnet in the way of yarn guide passage in yarn winder to bobbin and irradiate the ionized air Eair from outside the magnet field generated by the magnet for activation the yarn. It is also recommended to place the magnet in the weaving line and irradiate the ionized air Eair from outside the magnetic field generated by the magnet for activation the yarn. It is another way of recommendation to irradiate E air to a used cloth or a cloth to be used from now.

In case to activate a floss of feather or raw cotton wool in place of the textile product, it is preferable to stir the wool (feather) of floss of cotton wool and irradiate the ionized gas for activation is considered.

In this case, feather or floss should be supplied from the direction to easily fly and distributed. On the other hand, the electrode to activate the material by means of corona discharge should be placed outside the stirring center of the stirring vessel. The supplying aperture of the ionized gas should be placed against each electrode to supply the ionized gas to be ionized. The magnet to accelerate activation should be placed at tip end of the irradiation axis.

With this result, feather or floss is activated with the ionized gas, respectively.

When feather or floss is activated with ionized air, natural air is supplied in order to dilute ozone as aforementioned. Supply direction of the natural air is selected to meet the ionized air with natural air together.

In order to further improve activation of feather or floss by means of magnet it is recommended to place a second magnet at opposite outside of the irradiation axis of the ionized gas so that to increase degree of penetration of the ionized gas through the feather or floss. The irradiation degree of the ionized gas as per unit area of the sample is also tested.

Like that, the activation method and apparatus thereof according to the present invention is applied for activating the textile product 2 comprising natural fiber, synthetic fiber and filament, blended natural fiber and synthetic fiber, knitted product comprising natural yarn and synthetic yarn, and compound of these fibers and yarns and further the textile product 2 including down, feather, floss, etc.

In the preferred embodiments of the present invention, corona discharge apparatus 4 is applied as an example. Corona discharge irradiates ionized gas E. (It also irradiates ionized air Eair.) It is also possible to apply ionized gas E generated by means of plasma discharge from outside the magnetic field to the textile product 2.

In this case, generation amounts of the ionized gas E are varied in accordance with kind of discharge, thus distance between the aperture 4*e* and the plate is preferably selected in the scope of 20–35 cm which is possible to irradiate all the ionized gas E generated for discharge to the textile product 2.

If the surface of the plate 3 is made from the permanent magnet, the magnetic power to accelerate the activation is set to approximately 13,000 gauss. If a magnet over 13,000 gauss is required for more activation, an electric magnet is applied in accordance with necessary magnetic power.

In the preferred embodiment of the present invention a slit like aperture 4*e* is disclosed as an example for irradiation of the ionized gas E(Eair), it is also recommended to irradiate the ionized gas E(Eair) through a plurality of apertures located opposite position toward the electrodes 4*d*, 4*d*, . . . , respectively.

While the invention has been described in connection with what is presently considered to be the most practical and preferred embodiment, it is understood that the invention is not to be limited to the disclosed embodiment but, on the contrary, is intended to cover various modifications and equivalent arrangements included within the spirit and scope of the appended claims which scope is to be accorded the broadest interpretation so as to encompass all such modifications and equivalent structures.

EFFECTS OF THE INVENTION

In short, the present invention offers the following effects.

Claim 1 and claim 4 offer a method to activate the textile product placed in the magnetic field and the ionized gas is irradiated from outside the magnetic field toward inside the magnetic field. The magnetic field attracts the ionized gas and shut the ionized gas inside the magnetic field. For this reason, one irradiation can activate the textile product from surface to back, even if it is thick material. It is also possible to increase amounts of irradiation of the ionized gas per unit area. One irradiation can activate whole parts of the textile product evenly at a time. The present invention offers excellent effects.

Claim 2 and claim 5 offer a method and apparatus for discharging ionized gas to activate the textile product at a low price.

Claim 3 and claim 6 offer a method and apparatus to dilute ozone existing in ionized gas by supplying natural air to the ionized gas. Deterioration of the textile product by ozone is prevented.

What is claimed is:

1. An activation method of a textile product comprising such that the textile product is placed within magnetic field and the textile product is irradiated with an ionized gas.

2. An activation method of a textile product according to claim 1, wherein the ionized gas comprises an ionized air.

3. An activation method of a textile product according to claim 1, wherein ozone existing in the ionized air is diluted by supplying natural air to the ionized air.

4. An activation apparatus for a textile product comprising a magnetic field by means of generating such magnetic field and irradiation apparatus to irradiate an ionized gas to the textile product.

5. An activation apparatus for the textile product according to claim 4, wherein the ionized gas comprises an ionized air.

6. An activation apparatus for the textile product according to claim 4, wherein the apparatus further comprises an air supply means to dilute ozone existing in the ionized air by supplying natural air to the ionized air.

* * * * *